US007377866B2

(12) United States Patent
Van Nguyen

(10) Patent No.: US 7,377,866 B2
(45) Date of Patent: May 27, 2008

(54) MULTI-COMPONENT BAT HAVING THREADED CONNECTION AND ASSEMBLY PROCESS

(76) Inventor: Thu Van Nguyen, 24128 Hillhurst Dr., West Hills, CA (US) 91307

( * ) Notice: Subject to any disclaimer, the term of this patent is extended or adjusted under 35 U.S.C. 154(b) by 53 days.

(21) Appl. No.: 11/307,634

(22) Filed: Feb. 15, 2006

(65) Prior Publication Data

US 2007/0191156 A1 Aug. 16, 2007

(51) Int. Cl.
*A63B 59/06* (2006.01)

(52) U.S. Cl. ..... 473/566; 473/567

(58) Field of Classification Search ..... 473/457, 473/519, 520, 564–568
See application file for complete search history.

(56) References Cited

U.S. PATENT DOCUMENTS 537,927 A * 4/1895 Kennedy ..... 473/520
546,540 A * 9/1895 Kennedy ..... 473/520
3,877,698 A 4/1975 Volpe
4,025,377 A 5/1977 Tanikawa
4,907,800 A * 3/1990 Passamaneck et al. ..... 473/457
5,409,214 A 4/1995 Cook
5,451,047 A * 9/1995 Liu ..... 473/564
5,456,461 A * 10/1995 Sullivan ..... 473/437
5,516,097 A * 5/1996 Huddleston ..... 473/457
5,593,158 A 1/1997 Filice et al.
5,722,908 A 3/1998 Feeney et al.
6,042,493 A 3/2000 Chauvin et al.
6,050,908 A * 4/2000 Muhlhausen ..... 473/457
6,056,655 A 5/2000 Feeney et al.
6,099,422 A * 8/2000 Rappaport et al. ..... 473/567
6,432,006 B1 8/2002 Tribble
6,485,382 B1 11/2002 Chen
6,511,392 B1 1/2003 Chohan
D476,709 S 7/2003 Nguyen
6,609,984 B1 * 8/2003 Tribble ..... 473/564
6,702,698 B2 3/2004 Eggiman et al.
6,808,464 B1 10/2004 Nguyen
6,863,628 B1 * 3/2005 Brandt ..... 473/520
6,878,080 B2 * 4/2005 Chang ..... 473/564
2003/0069095 A1 * 4/2003 Turos ..... 473/457
2004/0224803 A1 * 11/2004 Forsythe et al. ..... 473/564
2005/0143203 A1 * 6/2005 Souders et al. ..... 473/564
2005/0288130 A1 * 12/2005 Lefebvre et al. ..... 473/457
2006/0252586 A1 * 11/2006 Nguyen ..... 473/564

* cited by examiner

*Primary Examiner*—Mark S Graham
(74) *Attorney, Agent, or Firm*—Kelly Lowry & Kelley LLP

(57) ABSTRACT

A process for assembling a multi-component baseball bat includes providing a bat barrel having a threaded section and selecting a bat handle having a threaded section. The barrel and handle are interconnected in a threaded engagement, defining an intermediate tapered section providing impact absorption and reducing stress on the barrel and handle resulting from repeated impacts of a ball on the bat. An example of a multi-component baseball bat formed by the process includes a bat barrel having a first threaded section; a bat handle having a second threaded section; and a mechanism for coaxially interconnecting the first and second threaded sections in an aligned relation in order to provide impact absorption and reduce stress on an interface of the barrel and handle resulting from repeated ball impacts on the bat. The interconnecting mechanism defines, at least in part, an intermediate tapered section between the barrel and handle.

26 Claims, 6 Drawing Sheets

MULTI-COMPONENT BAT HAVING THREADED CONNECTION AND ASSEMBLY PROCESS

BACKGROUND OF THE INVENTION

The present invention relates to baseball and softball bats. More particularly, the present invention relates to a multi-component bat.

Baseball and softball are very popular sports in the United States, Mexico, Cuba, Japan and elsewhere. Due to the competitive nature of the sports, players are constantly seeking ways of improving their performance. An important aspect of baseball and softball is the ability to effectively hit the ball. Aluminum (metal) bats are allowed in baseball amateur play from Little League to College levels. Metal bats are also typically used in slow and fast pitch softball. Such bats are advantageous over wood bats in that they do not break and splinter like wood bats and thus can be repeatedly used with consequent cost savings. Metal bats also have a larger optimal hitting area or power zone (commonly referred to as the "sweet spot") than wood bats. Furthermore, the ball comes off a metal bat faster than a wood bat resulting in longer hits.

However, metal bats have certain disadvantages. Metal bats vibrate upon impact and may send painful vibrations into the hands and arms of the batter if the ball is not hit within the power zone of the bat. Metal bats, particularly aluminum bats, may also dent or otherwise deform due to forceful impacts with the ball. Metal bats also emit an undesirable high-pitched metallic sound, as opposed to the traditional sound heard when a wood bat contacts the ball.

Various attempts have been made to overcome the problems associated with metal bats. Some attempts have been to coat or wrap the exterior of the metal bat with materials such as carbon reinforcing fibers to enhance batting performance. These externally wrapped bats have been found to be aesthetically unpleasant and lacking in significant improvement. Other attempts have been made to insert internal layers or compartments within the metal bat to improve performance. Bats have been devised that incorporate both metal and composite materials. Such designs include utilizing multiple-layered graphite inserts to provide durability and flexibility to the bat, tubular coiled spring steel inserts to improve the spring-board effect when the ball contacts the bat, and pressurized air chambers within the bat. Bats that incorporate composite materials tend to be much lighter than metal bats. While providing benefits, these designs also have drawbacks. Some designs are very expensive to manufacture and are prone to structural failure. The composite sheaths break down over time, the bats are subject to premature longitudinal cracks in the barrel of the bat and damage is created at an interface of the metal and composite materials due to differences in the impact absorption and resistance characteristics of the materials.

Accordingly, there is a need for a bat which enhances the performance of the bat and overcomes the disadvantages previously experienced with metal bats. The present invention fulfills these needs and provides other related advantages.

SUMMARY OF THE INVENTION

The present invention resides in a method and apparatus that provides a multi-component bat.

A process for assembling a multi-component baseball bat includes providing a bat barrel having a threaded section. As part of the process, a bat handle having a threaded section is also selected. The barrel and handle are interconnected in a threaded engagement to define an intermediate tapered section which provides impact absorption and reduces stress on an interface of the barrel and handle resulting from repeated impacts of a ball on the bat.

Interconnection of the barrel and handle also has an effect of dampening vibrations created when the ball contacts the bat. The interconnection of the barrel and handle includes an end of the barrel enveloping a section of the handle. In this manner, an end of the barrel is received within an annular recess of the handle. The recess is tapered inwardly for engagement with the end of the barrel.

In an embodiment of the present invention, interconnection of the barrel and handle forms a corrugated section in the tapered section that amplifies a spring-board effect when the ball contacts the bat by allowing the bat to bend along the corrugated section upon impact and then spring back.

In another embodiment of the present invention, interconnection of the barrel and handle includes coaxially disposing a hollow tapered sleeve around the handle. This allows an end of the barrel to be received within an annular recess of the tapered sleeve.

An illustrative example of a multi-component baseball bat embodying the present invention, includes a bat barrel having a first threaded section; a bat handle having a second threaded section; and a mechanism for coaxially interconnecting the first and second threaded sections in an aligned relation in order to provide impact absorption and reduce stress on an interface of the barrel and handle. The stress on the interface results from repeated impacts of a ball on the bat. The interconnecting mechanism defines, at least in part, an intermediate tapered section between the bat barrel and bat handle.

The baseball bat includes a mechanism for dampening vibrations created when the ball contacts the bat by deflecting vibrations traveling along the bat.

The interconnecting mechanism of the baseball bat includes a section of the barrel enveloping an end of the handle as well as a section of the handle enveloping an end of the barrel. An annular recess of the handle receives an end of the barrel therein. The annular recess tapers inwardly for engagement with the end of the barrel. The interconnecting mechanism provides a generally continuous exterior surface of the baseball bat when the handle engages the barrel.

In an embodiment of the present invention, the dampening mechanism comprises a tapered, corrugated section. In another embodiment of the present invention, the baseball bat includes a tapered sleeve coaxially disposed around an exterior of the handle where the sleeve has an annular recess for receiving an end of the barrel therein.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
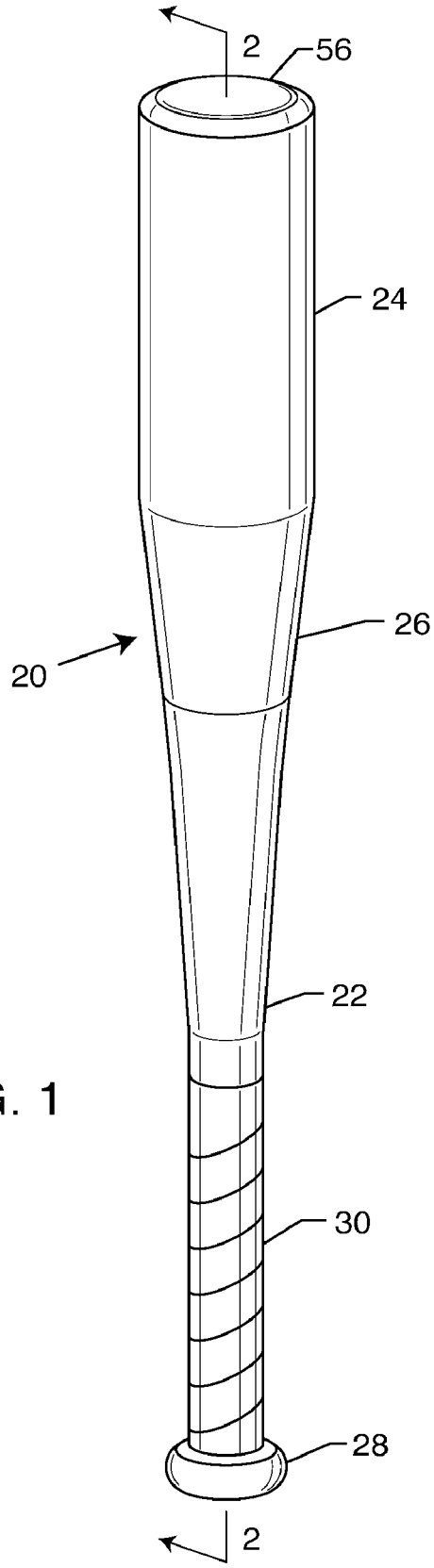
FIG. 1 is a perspective view of a baseball bat embodying the present invention.

As shown in FIGS. 1-12 for purposes of illustration, the present invention is concerned with a multi-component bat 20, 70, 120 for use in baseball or softball.

In one embodiment of the present invention, as seen in FIGS. 1-4, the multi-component bat 20 has an elongate hollow handle shell portion 22, an elongate hollow barrel shell portion 24 and an intermediate cylindrically tapered section 26 interconnecting the handle portion 22 and the barrel portion 24. A knob 28 is securely attached to the end of the handle portion 22 by a variety of means including, without limitation, bonding agents, glues, adhesives or the like. The knob 28 may be made of various materials including, without limitation, aluminum, magnesium, polyurethane, polycarbonate, a composite material, Zytel, Delrin, plastic or the like. Also, the handle portion 22 is typically wrapped with a grip 30 comprised of rubber, polyurethane, leather or the like, for comfort. The construction of the intermediate tapered section 26 dampens vibrations created when a ball contacts the bat 20 and provides limited pivotal movement of the barrel portion 24 relative to the handle portion 22 (i.e., a flex measured in microns).

The handle and barrel portions 22, 24 may be made of various materials including, without limitation, wood, a lightweight yet durable metal (e.g., aluminum, titanium, magnesium, or an alloy thereof), a composite material (e.g., fiberglass, carbon fibers, or a combination of glass and carbon fibers (e.g., 50/50 glass to carbon, 80/20 glass to carbon for a very flexible bat, 20/80 glass to carbon for a very stiff bat or any other ratio of glass to fiber in order to obtain a desired flex in the bat 20)) or the like. Each of the portions 22, 24 may be made of the same material or they may be made of different materials. Preferably, the handle portion 22 is comprised of a composite material and the and barrel portion 24 is comprised of a 6000 or 7000 series aluminum alloy in which zinc is the major alloying element coupled with a smaller percentage of magnesium, resulting in a heat-treatable alloy of very high strength. The barrel portion 24 is finished to a mechanical strength of T6/T7 Temper. In the alternative, the handle and barrel portions 22, 24 may both be made of composite materials (of equal or differing hardness) or metal (of equal of differing hardness). In another alternative, the barrel portion 24 may be made of a composite material, such as those described above, and the handle portion 22 made of a metal, such as those described above.

The handle and barrel portions 22, 24 each include a tapered first end 32, 34 having an aperture 36, 38. The intermediate tapered section 26 of the bat 20 is defined when an exterior surface of the tapered first end 32 of the handle portion 22 includes a threaded section having threads 40 that engage threads 42 of a threaded section on an interior surface of the tapered first end 34 of the barrel portion 24. The threaded engagement of the handle and barrel portions 22, 24 coaxially interconnects the handle and barrel portions 22, 24, in an aligned relation in order to provide impact absorption and reduce stress on an interface section 44 of the handle and barrel portions 22, 24 which forms a portion of the intermediate tapered section 26 of the bat 20. The stress on the interface section 44 results from repeated impacts of a ball on the bat 20. The intermediate tapered section 26 deflects vibrations traveling from the barrel portion 24 to the handle portion 22; deflecting the energy of the vibrations back into the barrel portion 24. The deflected energy is transmitted, at least in part, back to the ball.

The bat 20 may be assembled in a number of ways. In one particular way, the handle portion 22 is mated with the barrel portion 24 by inserting a second end 46 of the handle portion 22 through an open second end 48 of the barrel portion 24. The exterior diameters of the second end 46 of the handle portion 22 are smaller than the interior diameters of the first and second ends 34, 48 of the barrel portion 24 such that the handle portion 22 passes through the interior of the barrel portion 24 until the threads 40, 42 of the handle and barrel portions 22, 24 abut against each other. At that point, the threads 40 of the handle portion 22 are rotated relative to the threads 42 of the barrel portion 24 to engage the handle portion 22 with the barrel portions 24.

As the handle portion 22 passes through the barrel portion 24, a section 50 of the handle portion 22 passes through the aperture 38 of the barrel portion 24. This section 50 of the handle portion 22 defines an annular recess 52 of the handle portion 22 for receiving the tapered end 34 of the barrel portion 24 therein.

Interconnection of the handle and barrel portions 22, 24 results in a section 54 of the tapered end 34 of the barrel portion 24 enveloping the tapered end 32 of the handle portion 22 as well as the section 50 of the handle portion 22 enveloping a portion of the tapered end 34 of the barrel portion 24 when the annular recess 52 of the handle portion 22 receives the portion of the tapered end 34 of the barrel portion 24 therein. The annular recess 52 tapers inwardly for engagement with the end 34 of the barrel portion 24. The interconnection of the handle and barrel portions 22, 24 also provides a generally continuous exterior surface of the baseball bat 20 when the handle portion 22 engages the barrel portion 24.

The components of the intermediate tapered section 26 tightly fit together to isolate vibrations which insulates the handle portion 22 from vibrations generated in the barrel portion 24 when a ball strikes the barrel portion 24. The length of the intermediate tapered section 26 will be varied based on the size and type of bat (e.g., adult baseball bat, youth baseball bat, softball bat or the like). A high strength bonding glue 55 (e.g. rubberized glue, rubber cement, etc.) may be applied to all joins to secure all the connections, especially between the threads 40, 42 of the handle and barrel portions 22, 24. The glue 55 helps to dampen vibrations, fill in gaps and allow additional flexibility. The flexibility of the glue 55 helps to give the bat 20 a whipping effect since the two materials that form, respectively, the handle and barrel portions 22, 24 flex at different rates (the barrel portion 24 flexing more than the handle portion 22) and the glue 55 provides a flexible cushion along the interface of the handle and barrel portions 22, 24.

The end 48 of the barrel portion 24 is typically open and directed inward for acceptance and retention of a cap or end plug 56. The end plug 56 is typically comprised of urethane, polyurethane, Zytel or the like. The end plug 56 has a circumferential groove 58 which accepts an inwardly directed annular lip 60 of the barrel portion 24. The end plug 56 is then secured to the end 48 of the barrel portion 24.

In another embodiment of the present invention, as seen in FIGS. 5-8, the multi-component bat 70, similar to the bat 20 described above, has an elongate hollow handle shell portion 72, an elongate hollow barrel shell portion 74 and an intermediate cylindrically tapered section 76 interconnecting the handle portion 72 and the barrel portion 74. A knob 78 is securely attached to the end of the handle portion 72 by a variety of means including, but not limited to, bonding agents, glues, adhesives or the like. The knob 78 may be made of various materials including, without limitation, aluminum, magnesium, Zytel, Delrin, plastic, polyurethane, polycarbonate, a composite material or the like. Also, the handle portion 72 is typically wrapped with a grip 80 comprised of rubber, polyurethane, leather or the like, for comfort. The construction of the intermediate tapered section 76 dampens vibrations created when a ball contacts the bat 70 and provides limited pivotal movement of the barrel portion 74 relative to the handle portion 72 (i.e., a flex measured in microns).

The handle and barrel portions 72, 74 may be made of various materials including, without limitation, wood, a lightweight yet durable metal (e.g., aluminum, titanium, magnesium, or an alloy thereof), a composite material (e.g., fiberglass, carbon fibers, or a combination of glass and carbon fibers (e.g., 50/50 glass to carbon, 80/20 glass to carbon for a very flexible bat, 20/80 glass to carbon for a very stiff bat or any other ratio of glass to fiber in order to obtain a desired flex in the bat 70)) or the like. Each of the portions 72, 74 may be made of the same material or they may be made of different materials. Preferably, the handle portion 72 is comprised of a composite material and the barrel portion 74 is comprised of a 6000 or 7000 series aluminum alloy in which zinc is the major alloying element coupled with a smaller percentage of magnesium, resulting in a heat-treatable alloy of very high strength. The barrel portion 74 is finished to a mechanical strength of T6/T7 Temper. In the alternative, the handle and barrel portions 72, 74 may both be made of composite materials (of equal or differing hardness) or metal (of equal of differing hardness). In another alternative, the barrel portion 74 may be made of a composite material, such as those described above, and the handle portion 72 made of a metal, such as those described above.

The handle and barrel portions 72, 74 each include a tapered first end 82, 84 having an aperture 86, 88. The intermediate tapered section 76 of the bat 70 is defined when an exterior surface of the tapered first end 82 of the handle portion 72 includes threads and/or corrugations 90 that engage threads and/or corrugations 92 on an interior surface of the tapered first end 84 of the barrel portion 74. The engagement of the handle and barrel portions 72, 74 coaxially interconnects the handle and barrel portions 72, 74, in an aligned relation in order to provide impact absorption and reduce stress on an interface section 94 of the handle and barrel portions 72, 74 which forms a portion of the intermediate tapered section 76 of the bat 70. The stress on the interface section 94 results from repeated impacts of a ball on the bat 70. The interface section 94 includes a tapered, corrugated section 96 that serves as a mechanism for dampening vibrations created when the ball contacts the bat 70 by deflecting vibrations traveling along the bat 70. The intermediate tapered section 76 deflects vibrations traveling from the barrel portion 74 to the handle portion 72; deflecting the energy of the vibrations back into the barrel portion 74. The deflected energy is transmitted, at least in part, back to the ball.

The corrugated section 96 is generally comprised of a plurality of rounded curves that form a wave-like surface on the inner and outer surfaces of the tapered ends 82, 84 of the handle and barrel portions 72, 74. Though each curve is generally rounded, the 'peak' of each curve may also comprise a flat section generally parallel to the slope of the tapered section 76. The length of the corrugated section 96 formed by the handle and barrel portions 72, 74 can be varied to cover a short section (less than half the length of the tapered section 76), the entire length of the tapered (sloped) section 76 formed by the handle and barrel portions 72, 74, or any length therebetween. Preferably, the length of the corrugated section 96 takes up approximately 10%-75% of the length of the tapered section 76. The corrugated section 96 improves and amplifies the spring-board effect when the ball contacts the bat 70 by allowing the bat 70 to bend along the corrugated section 96 upon impact and then spring back to its original shape. The corrugated section 96 also reduces vibrations in that the wave-like, or bending, surface of the corrugated section 96 deflects vibrations traveling along the length of the handle and barrel portions 72, 74, thus reducing the vibration created when a ball contacts the bat 70. The width and depth of the corrugated structure can be varied to obtain the ultimate performance of the bat 70, depending on the design of the bat 70.

The bat 70 may be assembled in a number of ways. In one particular way, the handle portion 72 is mated with the barrel portion 74 by inserting a second end 98 of the handle portion 72 through an open second end 100 of the barrel portion 74. The exterior diameters of the second end 98 of the handle portion 72 are smaller than the interior diameters of the first and second ends 84, 100 of the barrel portion 74 such that the handle portion 72 passes through the interior of the barrel portion 74 until the corrugations 90, 92 of the handle and barrel portions 72, 74 abut against each other. At that point, the corrugations 90 of the handle portion 72 are rotated relative to the corrugations 92 of the barrel portion 74 to engage the handle portion 72 with the barrel portion 74.

As the handle portion 72 passes through the barrel portion 74, a section 102 of the handle portion 72 passes through the aperture 88 of the barrel portion 74. This section 102 of the handle portion 72 defines an annular recess 104 of the handle portion 72 for receiving the tapered end 84 of the barrel portion 74 therein.

Interconnection of the handle and barrel portions 72, 74 results in a section 106 of the tapered end 84 of the barrel portion 74 enveloping the tapered end 82 of the handle portion 72 as well as the section 102 of the handle portion 72 enveloping a portion of the tapered end 84 of the barrel portion 74 when the annular recess 104 of the handle portion 72 receives the portion of the tapered end 84 of the barrel portion 74 therein. The annular recess 104 tapers inwardly for engagement with the end 84 of the barrel portion 74. The interconnection of the handle and barrel portions 72, 74 also provides a generally continuous exterior surface of the baseball bat 70 when the handle portion 72 engages the barrel portion 74.

The components of the intermediate tapered section 76 tightly fit together to isolate vibrations which insulates the handle portion 72 from vibrations generated in the barrel portion 74 when a ball strikes the barrel portion 74. The length of the intermediate tapered section 76 will be varied based on the size and type of bat (e.g., adult baseball bat, youth baseball bat, softball bat or the like). A high strength bonding glue 107 (e.g., rubberized glue, rubber cement, etc.) may be applied to all joins to secure all the connections, especially between the threads and/or corrugations 90, 92 of the handle and barrel portions 72, 74. The glue helps to dampen vibrations, fill in gaps and allow additional flexibility. The flexibility of the glue 107 helps to give the bat 70 a whipping effect since the two materials that form, respectively, the handle and barrel portions 72, 74 flex at different rates (the barrel portion 74 flexing more than the handle portion 72) and the glue 107 provides a flexible cushion along the interface of the handle and barrel portions 72, 74.

The end 100 of the barrel portion 74 is typically open and directed inward for acceptance and retention of a cap or end plug 108. The end plug 108 is typically comprised of urethane, polyurethane, Zytel or the like. The end plug 108 has a circumferential groove 110 which accepts an inwardly directed annular lip 112 of the barrel portion 74. The end plug 108 is then secured to the end 98 of the barrel portion 74.

In an additional embodiment of the present invention, as seen in FIGS. 9-12, the multi-component bat 120, similar to the bats 20, 70 described above, has an elongate hollow handle shell portion 122, an elongate hollow barrel shell portion 124 and an intermediate cylindrically tapered section 126 interconnecting the handle portion 122 and the barrel portion 124. A knob 128 is securely attached to the end of the handle portion 122 by a variety of means including, without limitation, bonding agents, glues, adhesives or the like. The knob 128 may be made of various materials including, without limitation, aluminum, magnesium, polyurethane, polycarbonate, a composite material, Zytel, Delrin, plastic or the like. Also, the handle portion 122 is typically wrapped with a grip 130 comprised of rubber, polyurethane, leather or the like, for comfort. The construction of the intermediate tapered section 126 dampens vibrations created when a ball contacts the bat 120 and provides limited pivotal movement of the barrel portion 124 relative to the handle portion 122 (i.e., a flex measured in microns).

The handle and barrel portions 122, 124 may be made of various materials including, without limitation, wood, a lightweight yet durable metal (e.g., aluminum, titanium, magnesium, or an alloy thereof), a composite material (e.g., fiberglass, carbon fibers, or a combination of glass and carbon fibers (e.g., 50/50 glass to carbon, 80/20 glass to carbon for a very flexible bat, 20/80 glass to carbon for a very stiff bat of any other ratio of glass to carbon in order to obtain a desired flex in the bat 120)) or the like. Each of the portions 122, 124 may be made of the same material or they may be made of different materials. Preferably, the handle portion 122 is comprised of a composite material and the barrel portion 124 is comprised of a 6000 or 7000 series aluminum alloy in which zinc is the major alloying element coupled with a smaller percentage of magnesium, resulting in a heat-treatable alloy of very high strength. The handle and barrel portions 122, 124 are finished to a mechanical strength of T6/T7 Temper. In the alternative, the handle and barrel portions 122, 124 may both be made of composite materials (of equal or differing hardness) or metal (of equal of differing hardness). In another alternative, the barrel portion 124 may be made of a composite material, such as those described above, and the handle portion 122 made of a metal, such as those described above.

The handle and barrel portions 122, 124 each include a tapered first end 132, 134 having an aperture 136, 138. The intermediate tapered section 126 of the bat 120 is defined when an exterior surface of the tapered first end 132 of the handle portion 122 includes a threaded section having threads 140 that engage threads 142 of a threaded section on an interior surface of the tapered first end 134 of the barrel portion 124.

The intermediate section 126 includes a hollow, tapered sleeve 144 that is coaxially disposed around an exterior of the first end 132 of the handle portion 122. The sleeve 144 has an outer section 146 defining an annular recess 148 for receiving the end 134 of the barrel portion 124 therein. The sleeve 144 is cylindrically tapered with a central bore 150 having first and second tapered ends 152, 154. The angle of the first tapered end 152 matches the angle of a first exterior shoulder 156 of an angled section 158 of the first end 132 of the handle portion 122; the angle of the end 152 being between zero and forty-five degrees. The angle of the end 154 matches the angle of a second exterior shoulder 160 of the angled section 158 of the first end 132 of the handle portion 122; the angle of the second tapered end 152 being between zero and forty-five degrees. The sleeve 144 friction-fit engages the angled section 158 of the first end 132 of the handle portion 122. The sleeve 144 is comprised of a material to dampen vibrations created when a ball contacts the bat 120; isolating shock transmission from the barrel portion 124 to a hand of a batter gripping the handle portion 122 when a ball is in contact with the bat 120. This material comes in various forms including, without limitation, an elastomeric material (e.g., solid rubber, high performance rubber foam, silicone or similar materials), polyurethane, polycarbonate, or a composite material (e.g., fiberglass, carbon fibers, or a combination of glass and carbon fibers). The engagement of the handle portion 122, sleeve 144 and barrel portion 124 coaxially interconnects the handle and barrel portions 122, 124, in an aligned relation in order to provide impact absorption and reduce stress on an interface section 162 of the handle and barrel portions 122, 124 which forms a portion of the intermediate tapered section 126 of the bat 120. The stress on the interface section 162 results from repeated impacts of a ball on the bat 120. The intermediate tapered section 126 deflects vibrations traveling from the barrel portion 124 to the handle portion 122; deflecting the energy of the vibrations back into the barrel portion 124. The deflected energy is transmitted, at least in part, back to the ball.

The bat 120 may be assembled in a number of ways. In one particular way, the handle portion 122 is mated with the barrel portion 124 by inserting a second end 164 of the handle portion 122 through an open second end 166 of the barrel portion 124. Prior to this, the second end 164 of the handle portion 122 is inserted through the central bore 150 of the sleeve 144 until the sleeve 144 engages the angled section 158 of the handle portion 122. The exterior diameters of the second end 164 of the handle portion 122 and the sleeve 144 are smaller than the interior diameters of the first and second ends 134, 166 of the barrel portion 124 such that the handle portion 122, with the sleeve 144, passes through the interior of the barrel portion 124 until the threads 140, 142 of the handle and barrel portions 122, 124 abut against each other. At that point, the threads 140 of the handle portion 122 are rotated relative to the threads 142 of the barrel portion 124 to engage the handle portion 122 and sleeve 144 with the barrel portion 124. As the handle portion 122 passes through the barrel portion 124, the section 146 of the sleeve 144 passes through the aperture 138 of the barrel portion 124. This section 146 of the handle portion 122 defines the annular recess 148 of the sleeve 144 for receiving the tapered end 134 of the barrel portion 124 therein.

Interconnection of the handle portion 122, sleeve 144 and barrel portion 124 results in a section 168 of the tapered end 34 of the barrel portion 24 enveloping the tapered end 132 of the handle portion 122 and an upper portion of the sleeve 144 as well as a portion of the sleeve 144 engaging the second exterior shoulder 160 of the angled section 158 of the tapered end 132 of the handle portion 122 and enveloping a portion of the tapered end 134 of the barrel portion 124 when the annular recess 148 of the sleeve 144 receives the portion of the tapered end 134 of the barrel portion 124 therein. The annular recess 148 tapers inwardly for engagement with the end 134 of the barrel portion 124. The interconnection of the handle portion 122, sleeve 144 and barrel portion 124 also provides a generally continuous exterior surface of the baseball bat 120 when the handle portion 122 and sleeve 144 engage the barrel portion 124.

The components of the intermediate tapered section 126 tightly fit together to isolate vibrations which insulates the handle portion 122 from vibrations generated in the barrel portion 124 when a ball strikes the barrel portion 124. The length of the intermediate tapered section 126, especially the sleeve 144, will be varied based on the size and type of bat (e.g., adult baseball bat, youth baseball bat, softball bat or the like). A high strength bonding glue 169 (e.g., rubberized glue, rubber cement, etc.) may be applied to all joins to secure all the connections, especially between the threads 140, 142 of the handle and barrel portions 122, 124 as well as between the sleeve 144 and the handle and barrel portions 122, 124. The glue helps to dampen vibrations, fill in gaps, and allow additional flexibility. The flexibility of the glue 169 helps to give the bat 120 a whipping effect since the two materials that form, respectively, the handle and barrel portions 122, 124 flex at different rates (the barrel portion 124 flexing more than the handle portion 122) and the glue 169 provides a flexible cushion along the interface of the handle and barrel portions 122, 124.

The end 166 of the barrel portion 124 is typically open and directed inward for acceptance and retention of a cap or end plug 170. The end plug 170 is typically comprised of urethane, polyurethane, Zytel or the like. The end plug 170 has a circumferential groove 172 which accepts an inwardly directed annular lip 174 of the barrel portion 124. The end plug 170 is then secured to the end 166 of the barrel portion 124.

An example of several methods of manufacturing the bat 20, 70, 120 of the present invention will now be described. It is to be understood that the methods used may be altered in some respects while still creating a bat 20, 70, 120 having the desired characteristics. Also, certain dimensions, materials, temperatures, etc. may be altered depending upon the size, weight and intended use of the resulting bat 20, 70, 120. The connection between the handle 22, 72, 122 and barrel portions 24, 74, 124 allows the balance between the handle 22, 72, 122 and barrel portions 24, 74, 124 to be adjusted so that the majority of the weight of the bat 20, 70, 120 is at the intermediate section 27, 76, 126. The position of the intermediate section 26, 76, 126 along the length of the bat 20, 70, 120 may be adjusted as well as the length and/or thickness of the intermediate section 26, 76, 126. In general, the barrel portion 24, 74, 124 has a minimum thickness of 0.070 inches and a maximum thickness of 0.115 inches. The thickness of the connection area of the bat 20, 70, 120 is determined by the weight/size of the bat 20, 70, 120.

The composite material handle portions 22, 72, 122 may be manufactured using a variety of techniques. These techniques include, but are not limited to: resin transfer molding (RTM); vacuum resin transfer molding (VRTM); filament winding and wrapping technique. Using RTM, various layers of the composite material are pre-manufactured to from the handle portion 22, 72, 122. Wrapping technique provides a layer-by-layer formation of the handle portion 22, 72, 122 that allows the manufacturer to control the flexibility of the handle portion 22, 72, 122. In general, the handle portion 22, 72, 122 is formed by approximately sixteen to twenty layers of composite material, depending on fiber type, fiber thickness (0.001-0.003 inches), fiber area weight (FAW) and flex.

A metal tube, such as an aluminum alloy tube, is provided at predetermined lengths and weights prior to manufacturing. For purposes of the following example, an aluminum alloy tube is provided for the manufacture of the barrel portion 24, 74, 124 for the bat 20, 70, 120.

The metal tube is first thermally treated. This is often referred to in the art as an annealing process. The thermal treatment softens the metal by removing the stress resulting from cold working. This process is to be repeated after a certain amount of cold work has been performed on the metal tubes. Before each cold forming process, the temperature of an anneal oven is set at four hundred ten degrees Centigrade. The aluminum tube is heated in the oven at this temperature for approximately three hours. The oven temperature is then decreased by twenty degrees Centigrade per hour, after the three hour soak time, until the temperature of the tubes has reached twenty degrees Centigrade. The aluminum tube is then heated at a temperature of two hundred thirty degrees Centigrade for two hours, at which point the oven temperature is reset to one hundred forty degrees Centigrade. The tube is removed from the oven when the temperature of the oven has reached one hundred forty degrees Centigrade.

The tube is then cleaned. During the annealing process, an oxidation scale develops on the surface of the aluminum tube. An acid cleaning process is required to remove the oxidation scale. The tube is soaked in a sulfuric acid solution for approximately thirty minutes to remove the oxidation scale each time the tube is annealed.

The tube is then formed into the barrel portion 24, 74, 124 of desired thickness, contour and length. This wall forming process is a cold working process. It is performed to obtain a wall of a desired thickness. Several cold forming passes may have to be performed depending upon several factors including metal type and the type of bat 20, 70, 120 desired. In the instant example, the tube forming the aluminum barrel portion 24, 74, 124 is subject to the cold working process on the outside diameter and the wall thickness simultaneously to obtain a wall thickness ranging from the minimum thickness of 0.070 inches to the maximum thickness of 0.115 inches. The barrel portion 24, 74, 124 is then cleaned. A degreasing process is required to remove all lubricants and residue substances out of the aluminum barrel portion 24, 74, 124. This is performed using an ultrasonic method with a detergent agent before and after the aluminum tube is annealed.

The barrel portion 24 74, 124 is then cut, trimmed and swaged to a desired length and contour. A thin end of the aluminum barrel portion 24, 74, 124 is trimmed to a predetermined length. It is important to have the thin ends of the aluminum barrel portions 24, 74, 124 squarely trimmed to avoid folding problems when the tubes are swaged by a rotary taper swager. The aluminum barrel portion 24, 74, 124 is swaged with a rotary swaging machine to obtain the desired contour shape and wall thickness. In the instant example, the required wall thickness after swaging is generally a minimum thickness of 0.070 inches and a maximum thickness of 0.115 inches for the barrel portion 24, 74, 124.

The tapered sleeve 144 may be formed using conventional methods which may vary. The tapered sleeve 144 is shaped to obtain a desired contoured shape that will later assist in giving the exterior surface of the bat 120 a generally continuous appearance.

If necessary, after shaping, the barrel portion 24, 74, 124 is cut to the desired length.

The barrel portion 24, 74, 124 is then thermally treated, quenched and aged in order to obtain a T6/T7 Temper. It is commonly known in the art to expose metal or alloys to a heating and cooling treatment to obtain desired conditions, properties and an increase in strength. The barrel portion 24, 74, 124 is heat treated to obtain the highest tensile and yield strengths. The required temperature and time for the solution heat treatment is twenty-seven minutes at a temperature of four hundred eighty degrees Centigrade. After the barrel portion 24, 74, 124 is heat treated, they are quenched immediately with either air or water. Quenching is a controlled rapid cooling of a metal from an elevated temperature by contact with a liquid, gas or solid. Precipitation from solid solution results in a change in properties of the alloy, usually occurring rapidly at elevated temperatures. The barrel portion 24, 74, 124 is aged in an oven for twelve hours at one hundred thirty five degrees Centigrade.

After aging, the tapered ends 34, 84, 134 of the barrel portion 24, 74, 124 are contoured by machining. The inner portions of the tapered sections 54, 106, 168, as well as the threads/corrugations 42, 92, 142, are machined to obtain the desired configuration and dimensions to closely receive the threads/corrugations 40, 90, 140 and other parts of the handle 22, 72, 122. The end 34, 84, 134 of the barrel portion 24, 74, 124 is machined to achieve squareness and an angled interior surface of the section 54, 106, 168 in order to obtain a snug mating with the handle portion 22, 72, 122.

The barrel portion 24, 74, 124 is then cleaned again. Due to the treatments, the barrel portions 24, 74, 124 oxidizes. This oxidation is removed by an anodizing process. The barrel portion 24, 74, 124 is anodized for five minutes. To eliminate all possible contaminations, the surface of the barrel portion 24, 74, 124 is then thoroughly cleaned with methyl ethyl ketone.

At this point, the barrel portion 24, 74, 124 is assembled as outlined above, with respect to FIGS. 1-4, 5-8, and 9-12.

Thereafter, approximately a one half inch portion of the open barreled end 48, 100, 166 is rolled inward at a ninety degree angle to accommodate the end plug 56, 108, 170. If necessary, the protruded portion of the rolled portion is machined to achieve an opening of one and a quarter inches in diameter for installing the end plug 56, 108, 170.

The bat 20, 70, 120 is then polished and decorated. Any appropriate methods of polishing and decoration, as are well known in the art, can be applied. In the preferred embodiment, the outer surfaces of the barrel portion 24, 74, 124 is exposed to sodium hydroxide to strip an anodize coating created during the manufacturing process as well as to prepare the outer surface for anodic coating process. Typically, the concentration of the sodium hydroxide is fifty grams per liter. The outer surface of the barrel portion 24, 74, 124 is mechanically polished to obtain a mirror finish. The external surface of the barrel portion 24, 74, 124 is then anodized. In the alternative, the external surface of the barrel portion 24, 74, 124 may be painted, chromed, powder-coated, or covered by some other method of decorative coating. The outer surface of the barrel portion 24, 74, 124 may be decorated with a graphic by using various methods such as silkscreening, heat transferring, or pad stamping. The handle portion 22, 72, 122 may also be decorated using same/similar techniques.

The bat 20, 70, 120 is completed by attaching the knob 28, 78, 128 typically by gluing the knob 28, 78, 128 to an open end of the handle portion 22, 72, 122 opposite the tapered end 32, 82, 132. The grip 30, 80, 130 and the end plug 56, 108, 170 are also installed to finish the bat 20, 70, 120.

In the alternative, the above described method of manufacturing the bat 20, 70, 120 may be varied. For example, physical characteristics of the bat 20, 70, 120 such as the length, wall thickness or diameter may be increased or decreased.

Figure 2:
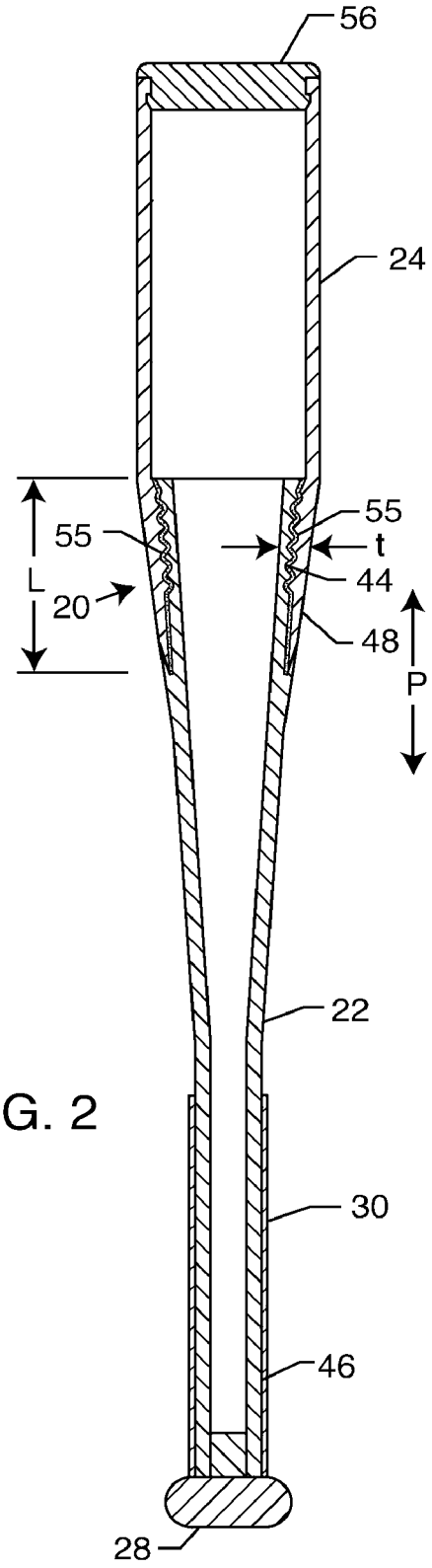
FIG. 2 is a cross-sectional view taken generally along the line 2-2 of FIG. 1, showing a bat barrel, bat handle, and mechanism for interconnecting the bat barrel and the handle.
Figure 3:
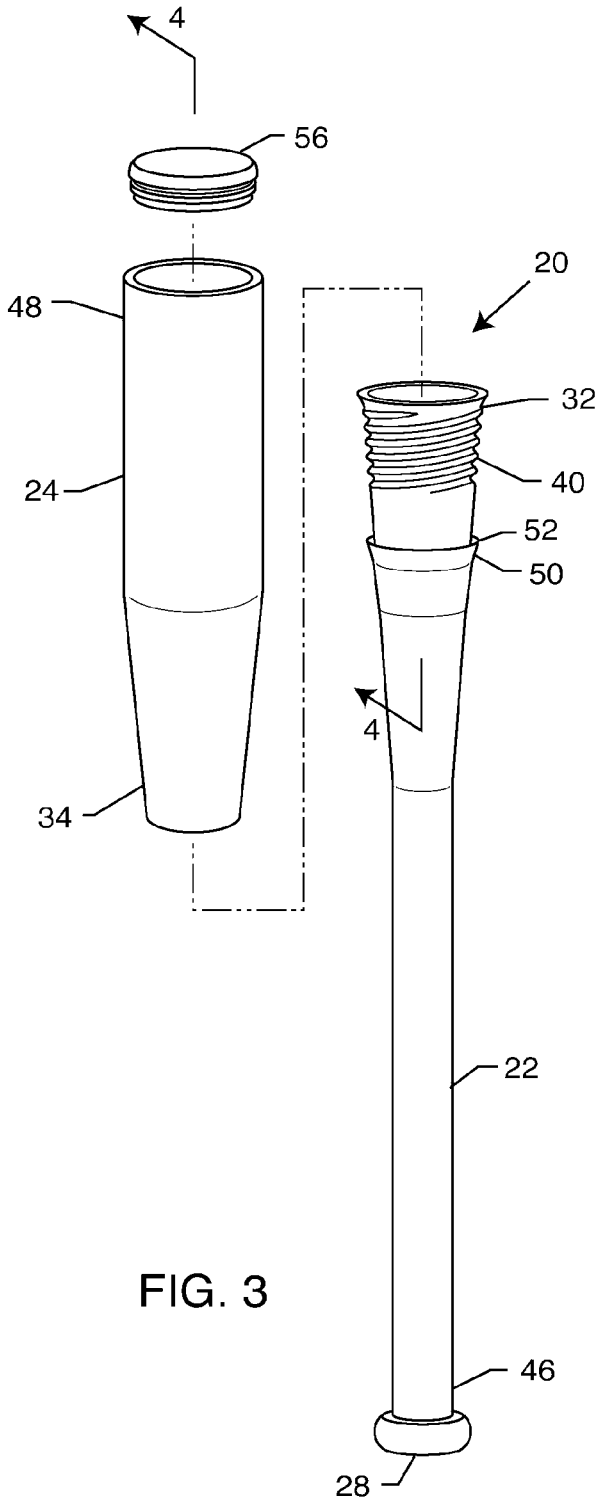
FIG. 3 is an exploded perspective view of the bat barrel, bat handle, and interconnecting mechanism of the baseball bat of FIGS. 1 and 2.
Figure 4:
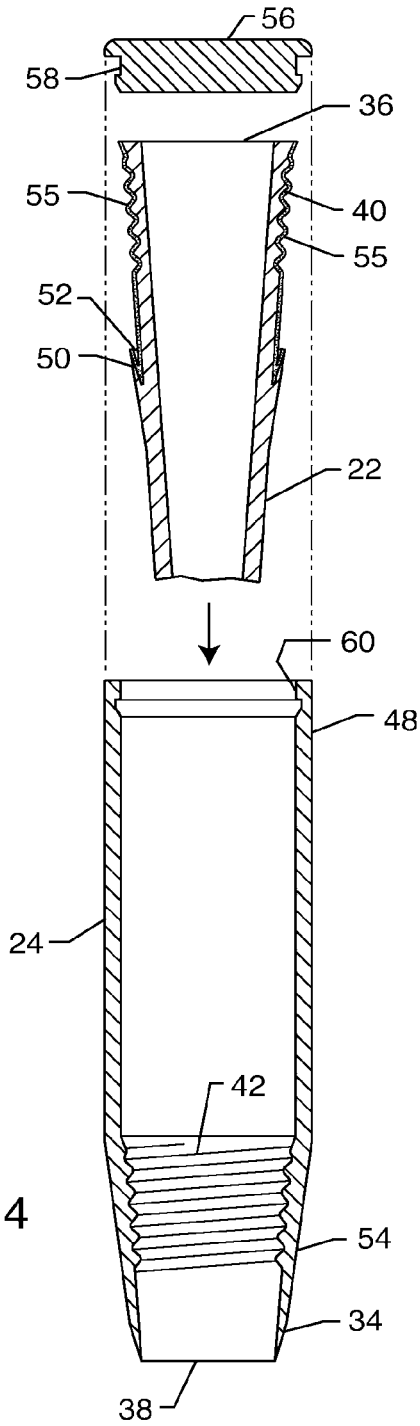
FIG. 4 is an exploded, cross-sectional view taken generally along the line 4-4 of FIG. 3.
Figure 5:
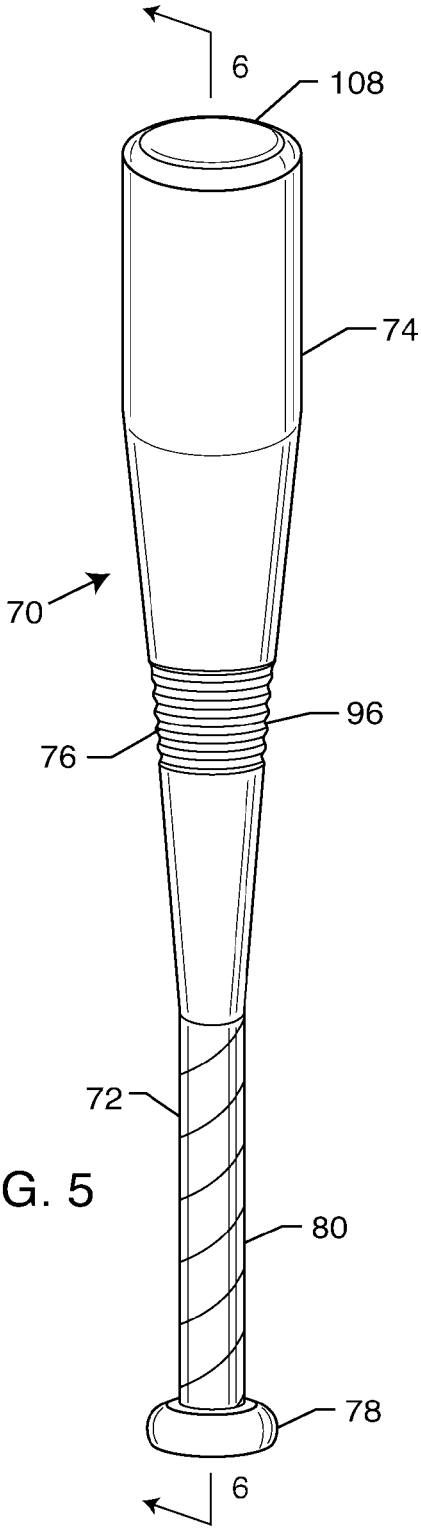
FIG. 5 is a perspective view of another baseball bat embodying the present invention.
Figure 6:
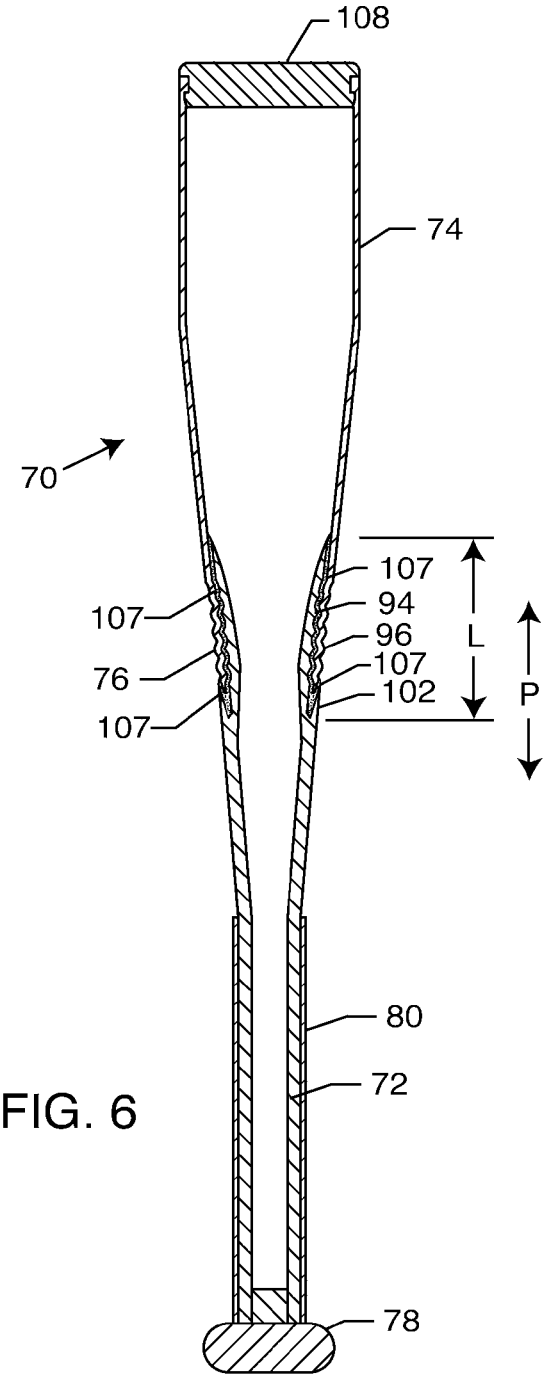
FIG. 6 is a cross-sectional view taken generally along the line 6-6 of FIG. 5, showing a bat barrel, bat handle, and mechanism for interconnecting the bat barrel and the handle.
Figure 7:
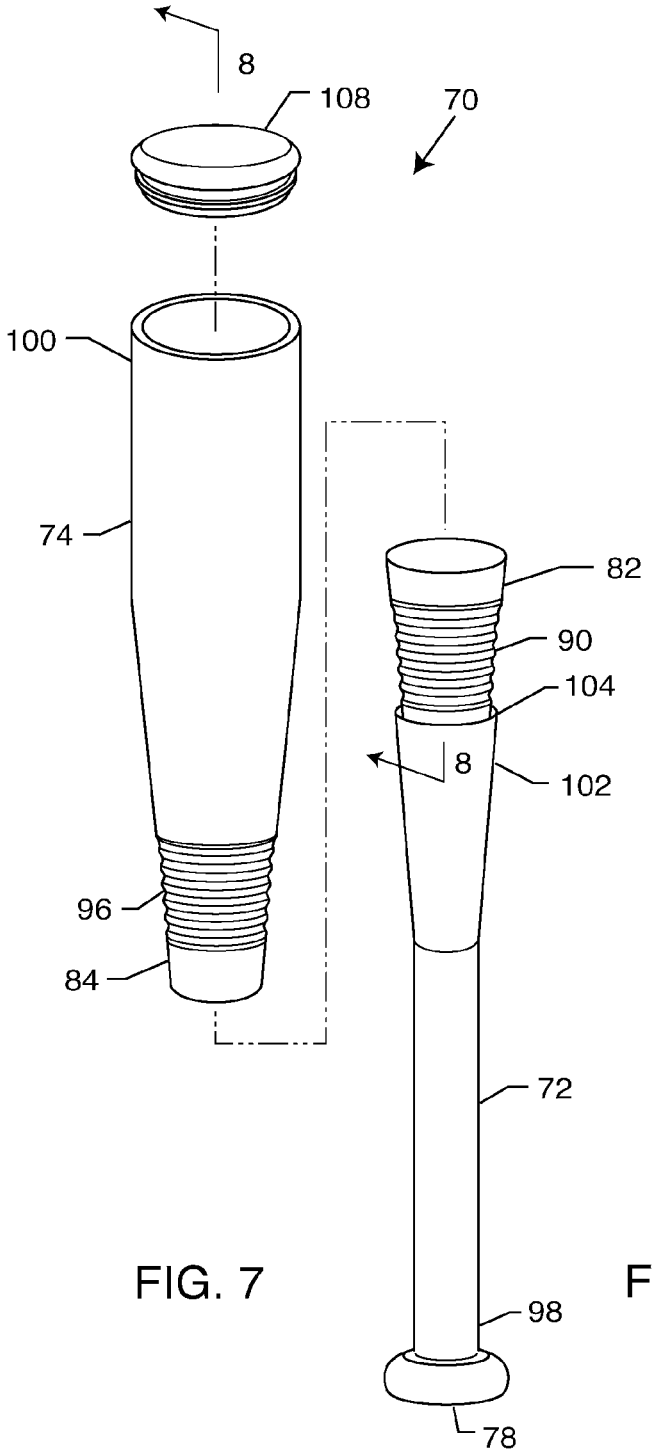
FIG. 7 is an exploded perspective view of the bat barrel, bat handle, and interconnecting mechanism of the baseball bat of FIGS. 5 and 6.
Figure 8:
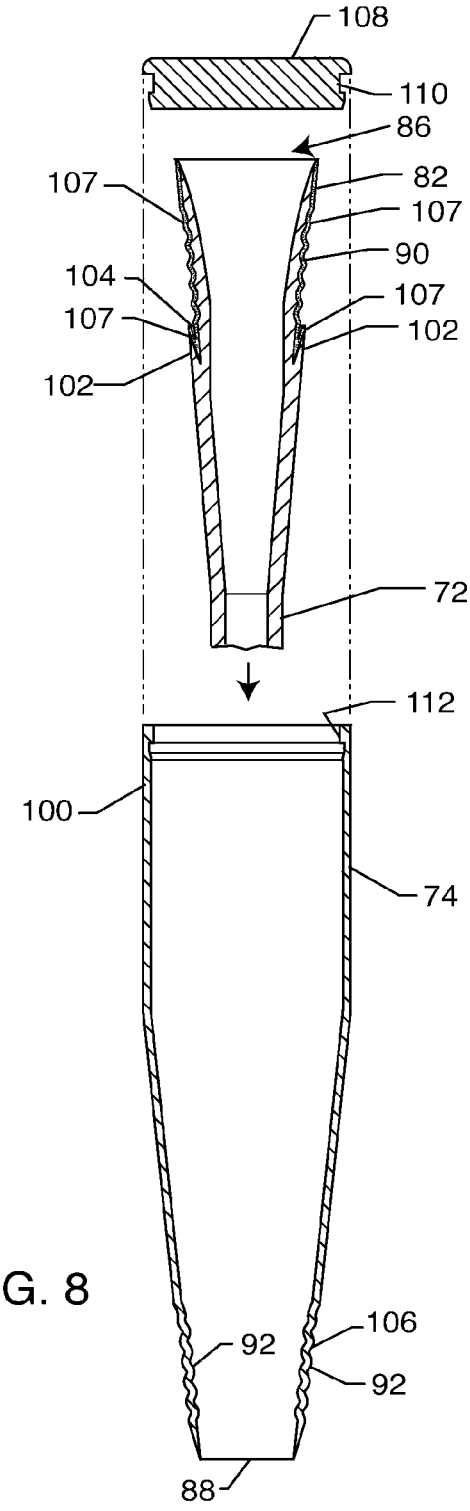
FIG. 8 is an exploded, cross-sectional view taken generally along the line 8-8 of FIG. 7.
Figure 9:
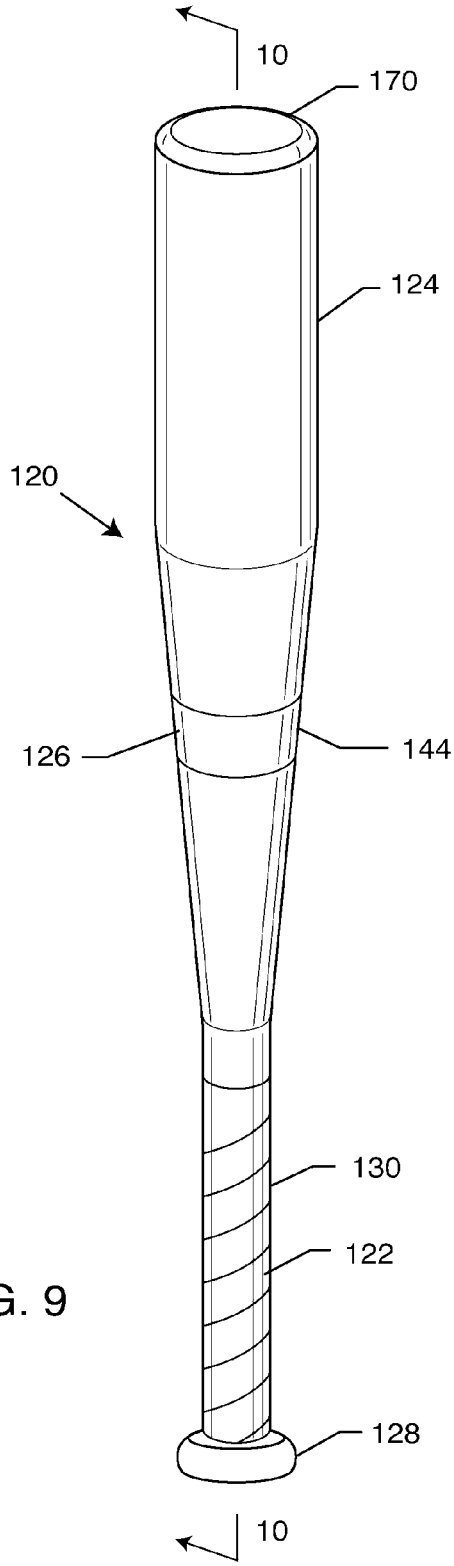
FIG. 9 is a perspective view of an additional baseball bat embodying the present invention.
Figure 10:
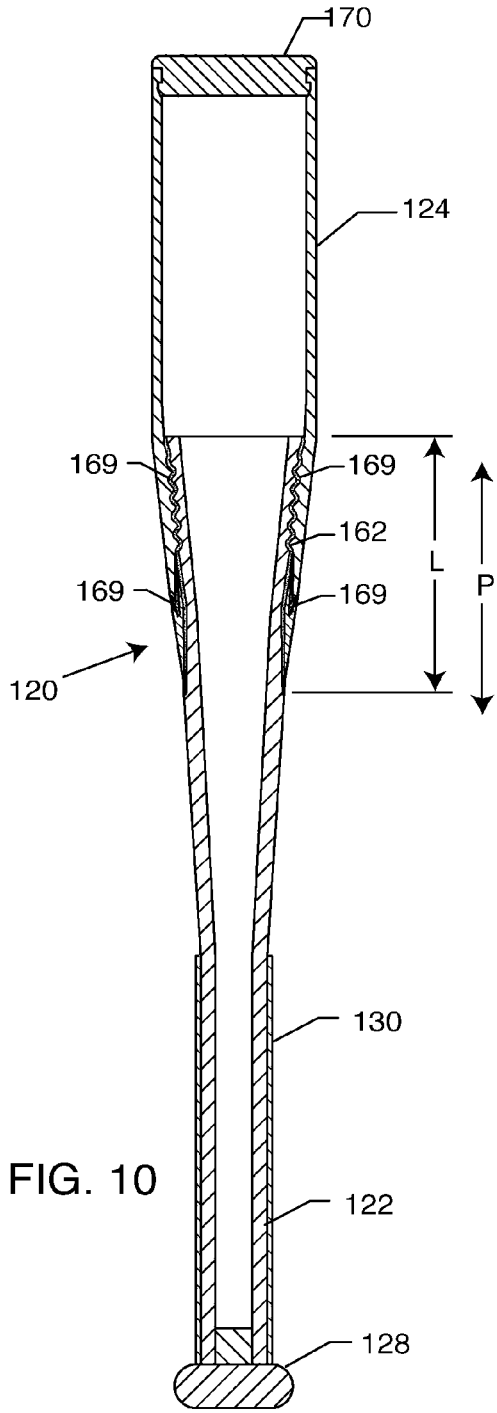
FIG. 10 is a cross-sectional view taken generally along the line 10-10 of FIG. 9, showing a bat barrel, bat handle, and mechanism for interconnecting the bat barrel and the handle.
Figure 11:
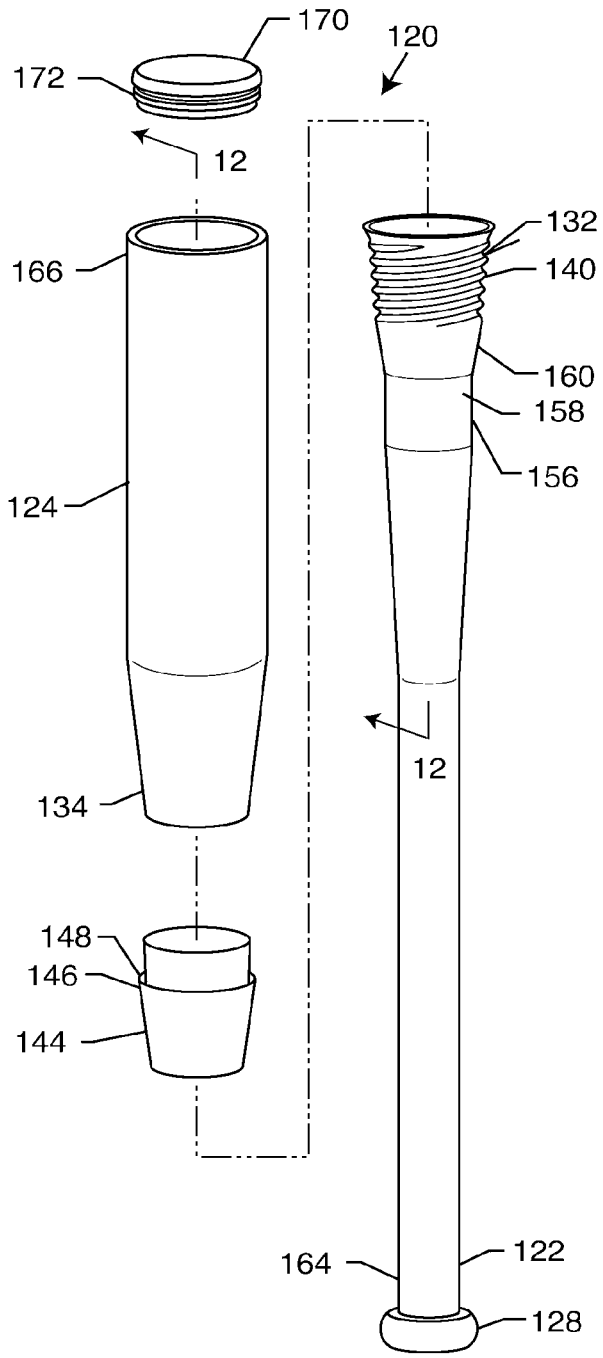
FIG. 11 is an exploded perspective view of the bat barrel, bat handle, and interconnecting mechanism of the baseball bat of FIGS. 9 and 10.
Figure 12:
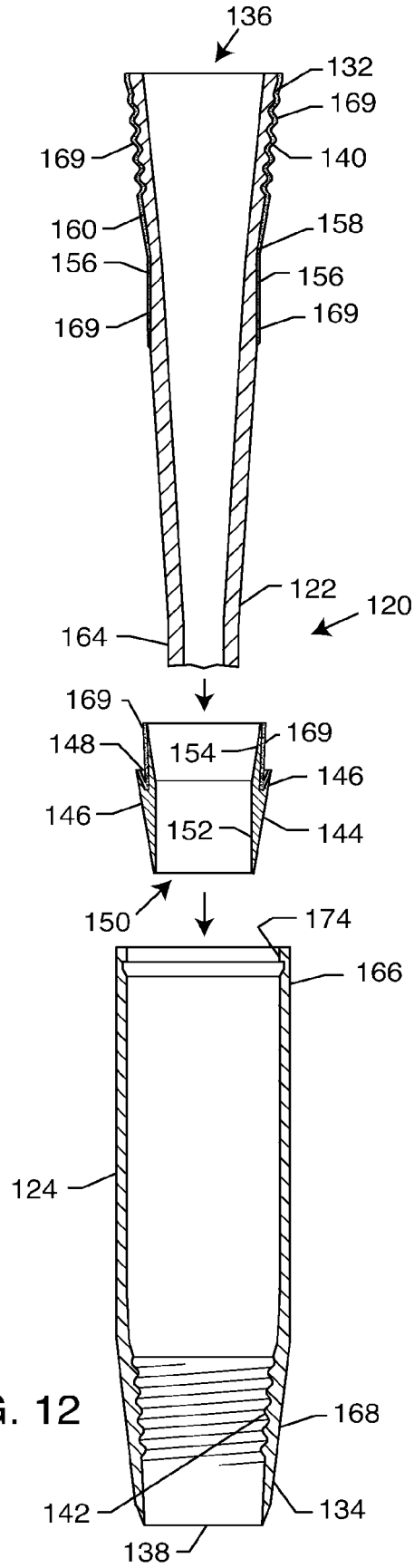
FIG. 12 is an exploded, cross-sectional view taken generally along the line 12-12 of FIG. 11.

An important feature of the bat 20, 70, 120 is the balance of the bat 20, 70, 120. The balance of the bat affects a user's control of the bat 20, 70, 120. The length L, thickness t and position P of the intermediate section 26, 76, 126 of the bat 20, 70, 120 affects the balance of the bat 20, 70, 120, as seen in FIGS. 2, 6, and 10, respectively.

Although constructed from affordable medium to high strength, light weight, and commercially available materials, the bat 20, 70, 120 of the present invention offers the performance and advantages of expensive and high strength materials. The bat 20, 70, 120 provides improved dent resistance. The bat 20, 70, 120 also dampens the vibrations created when traditional metal bats hit the ball that would otherwise sting the hitter's hand when a bat contacts a ball. Premature longitudinal cracking of the barrel portion 24, 74, 124 caused in traditional bats with thin wall thicknesses and high stress conditions, is avoided in the present invention.

The above-described embodiments of the present invention are illustrative only and not limiting. It will thus be apparent to those skilled in the art that various changes and modifications may be made without departing from this invention in its broader aspects. Therefore, the appended claims encompass all such changes and modifications as falling within the true spirit and scope of this invention.

What is claimed is:

1. A process for assembling a multi-component baseball bat, comprising the steps of:

providing a bat barrel having a threaded section;

selecting a bat handle having a threaded section; and interconnecting the barrel and handle in threaded engagement to define an intermediate tapered section which provides impact absorption and reduces stress on an interface of the barrel and handle resulting from repeated impacts of a ball on the bat;

wherein the interconnecting step includes the steps of enveloping a section of the handle with an end of the barrel, and receiving an end of the barrel within an annular recess of the handle.

2. The process of claim 1, wherein the interconnecting step includes the step of dampening vibrations created when the ball contacts the bat.

3. The process of claim 2, wherein the interconnecting step includes the step of forming a corrugated section in the tapered section that amplifies a spring-board effect when the ball contacts the bat by allowing the bat to bend along the corrugated section upon impact and then spring back.

4. The process of claim 1, wherein the receiving step includes the step of tapering the recess inwardly for engagement with the end of the barrel.

5. A process for assembling a multi-component baseball bat, comprising the steps of:

providing a bat barrel having a threaded section;

selecting a bat handle having a threaded section; and interconnecting the barrel and handle in threaded engagement to define an intermediate tapered section which provides impact absorption and reduces stress on an interface of the barrel and handle resulting from repeated impacts of a ball on the bat wherein the interconnecting step includes the steps of coaxially disposing a hollow tapered sleeve around the handle and receiving an end of the barrel within an annular recess of the tapered sleeve.

6. The process of claim 5, wherein the interconnecting step includes the step of dampening vibrations created when the ball contacts the bat.

7. The process of claim 6, wherein the interconnecting step includes the step of forming a corrugated section in the tapered section that amplifies a spring-board effect when the ball contacts the bat by allowing the bat to bend along the corrugated section upon impact and then spring back.

8. A process for assembling a multi-component baseball bat, comprising the steps of:

providing a bat barrel consisting of a metal material, composite material, or a combination of metal and composite material;

forming threads directly in an interior surface of the material of the bat barrel;

selecting a bat handle comprised of a metal, composite material, or a combination of metal and composite material, the handle having an exterior threaded section;

interconnecting the barrel and handle in threaded engagement to define an intermediate tapered section which provides impact absorption and reduces stress on an interface of the barrel and handle resulting from repeated impacts of a ball on the bat;

dampening vibrations created when the ball contacts the bat; and enveloping a section of the handle with an end of the barrel;

wherein the interconnecting step includes the steps of receiving an end of the barrel within an annular recess of the handle and tapering the recess inwardly for engagement with the end of the barrel.

9. The process of claim 8, wherein the interconnecting step includes the step of forming a corrugated section in the tapered section that amplifies a spring-board effect when the ball contacts the bat by allowing the bat to bend along the corrugated section upon impact and then spring back.

10. The process of claim 8, including the step of placing an adhesive between the threads of the bat barrel and bat handle.

11. A process for assembling a multi-component baseball bat comprising the steps of:

providing a bat barrel consisting of a metal material, composite material, or a combination of metal and composite material;

forming threads directly in an interior surface of the material of the bat barrel;

selecting a bat handle comprised of a metal, composite material, or a combination of metal and composite material, the handle having an exterior threaded section;

interconnecting the barrel and handle in threaded engagement to define an intermediate tapered section which provides impact absorption and reduces stress on an interface of the barrel and handle resulting from repeated impacts of a ball on the bat;

dampening vibrations created when the ball contacts the bat; and enveloping a section of the handle with an end of the barrel;

wherein the interconnecting step includes the steps of coaxially disposing a hollow tapered sleeve around the handle and receiving an end of the barrel within an annular recess of the tapered sleeve.

12. A multi-component baseball bat, comprising:

a bat barrel having a first threaded section;

a bat handle having a second threaded section; and means for coaxially interconnecting the first and second threaded sections in an aligned relation, to provide impact absorption and reduce stress on an interface of the barrel and handle resulting from repeated impacts of a ball on the bat; the interconnecting means defining, at least in part, an intermediate tapered section between the bat barrel and bat handle, wherein the interconnecting means including a section of the handle enveloping an end of the barrel, and an annular recess of the handle for receiving an end of the barrel therein.

13. The baseball bat of claim 12, including means for dampening vibrations created when the ball contacts the bat by deflecting vibrations traveling along the bat, the dampening means comprising a tapered, corrugated section.

14. The baseball bat of claim 12, wherein the interconnecting means includes a section of the barrel enveloping an end of the handle.

15. The baseball bat of claim 12, wherein the recess tapers inwardly for engagement with the end of the barrel.

16. The baseball bat of claim 12, wherein the interconnecting means provides a generally continuous exterior surface of the baseball bat when the handle engages the barrel.

17. A multi-component baseball bat, comprising:

a bat barrel having a first threaded section;

a bat handle having a second threaded section; and means for coaxially interconnecting the first and second threaded sections in an aligned relation, to provide impact absorption and reduce stress on an interface of the barrel and handle resulting from repeated impacts of a ball on the bat; the interconnecting means defining, at least in part, an intermediate tapered section between the bat barrel and bat handle;

wherein the interconnecting means includes a tapered sleeve coaxially around an exterior of the handle, having an annular recess for receiving an end of the barrel therein.

18. The baseball bat of claim 17, including means for dampening vibrations created when the ball contacts the bat by deflecting vibrations traveling along the bat, the dampening means comprising a tapered, corrugated section.

19. The baseball bat of claim 17, wherein the interconnecting means includes a section of the barrel enveloping an end of the handle.

20. The baseball bat of claim 17, wherein the interconnecting means provides a generally continuous exterior surface of the baseball bat when the handle engages the barrel.

21. A multi-component baseball bat, comprising:

a bat barrel consisting of a metal, composite material, or a combination of metal and composite material and having threads formed directly in the material of an inner surface of a first section thereof;

a bat handle comprised of a metal, composite material, or a combination of metal and composite material and having a second section with exterior threads formed thereon;

means for coaxially interconnecting the first and second threaded sections in an aligned relation, to provide impact absorption and reduce stress on an interface of the barrel and handle resulting from repeated impacts of a ball on the bat; the interconnecting means including a section of the handle enveloping an end of the barrel and defining, at least in part, an intermediate tapered section between the bat barrel and bat handle; and means for dampening vibrations created when the ball contacts the bat by deflecting vibrations traveling along the bat.

22. The baseball bat of claim 21, wherein the interconnecting means comprises an annular recess of the handle for receiving an end of the barrel therein and the recess tapers inwardly for engagement with the end of the barrel.

23. The baseball bat of claim 21, wherein the interconnecting means includes a tapered sleeve coaxially around an exterior of the handle, having an annular recess for receiving an end of the barrel therein.

24. The baseball bat of claim 21, wherein the interconnecting means provides a generally continuous exterior surface of the baseball bat when the handle engages the barrel.

25. The baseball bat of claim 21, wherein the dampening means comprises a tapered, corrugated section.

26. The baseball bat of claim 21, wherein the dampening means comprises an adhesive layer disposed between the interconnected threads of the bat barrel and the bat handle.

* * * * *